US008364479B2

(12) United States Patent
Schmidt et al.

(10) Patent No.: US 8,364,479 B2
(45) Date of Patent: Jan. 29, 2013

(54) SYSTEM FOR SPEECH SIGNAL ENHANCEMENT IN A NOISY ENVIRONMENT THROUGH CORRECTIVE ADJUSTMENT OF SPECTRAL NOISE POWER DENSITY ESTIMATIONS

(75) Inventors: Gerhard Uwe Schmidt, Ulm (DE); Tobias Wolff, Ulm (DE); Markus Buck, Biberach (DE)

(73) Assignee: Nuance Communications, Inc., Burlington, MA (US)

( * ) Notice: Subject to any disclaimer, the term of this patent is extended or adjusted under 35 U.S.C. 154(b) by 837 days.

(21) Appl. No.: 12/202,147

(22) Filed: Aug. 29, 2008

(65) Prior Publication Data

US 2009/0063143 A1 Mar. 5, 2009

(30) Foreign Application Priority Data

Aug. 31, 2007 (EP) ..... 07017134

(51) Int. Cl.
*G10L 21/02* (2006.01)

(52) U.S. Cl. ..... 704/228; 704/226; 704/200; 381/94.1; 381/94.2; 381/94.3

(58) Field of Classification Search ..... 704/200–230; 381/94.1–94.9, 71.1–71.14
See application file for complete search history.

(56) References Cited

U.S. PATENT DOCUMENTS 5,706,395 A * 1/1998 Arslan et al. ..... 704/226
6,289,309 B1 * 9/2001 deVries ..... 704/233
6,317,709 B1 * 11/2001 Zack ..... 704/225
6,625,448 B1 9/2003 Stern (Continued)

FOREIGN PATENT DOCUMENTS

EP 1 376 997 A1 1/2004
EP 1 883 213 A1 1/2008
GB 2 426 167 A 11/2006

OTHER PUBLICATIONS

V. Stahl, A. Fischer, R. Bippus, "Quantile based noise estimation for spectral subtraction and Wiener filtering," icassp, vol. 3, pp. 1875-1878, Acoustics, Speech, and Signal Processing, 2000 vol. 3. 2000 IEEE International Conference on, 2000.*

(Continued)

*Primary Examiner* — Pierre-Louis Desir
*Assistant Examiner* — Fariba Sirjani
(74) *Attorney, Agent, or Firm* — Sunstein Kann Murphy & Timbers LLP

(57) ABSTRACT

A system estimates the spectral noise power density of an audio signal includes a spectral noise power density estimation unit, a correction term processor, and a combination processor. The spectral noise power density estimation unit may provide a first estimate of the spectral noise power density of the audio signal. The correction term processor may provide a time dependent correction term based, at least in part, on a spectral noise power density estimation error of the actual spectral noise power density. The correction term may be determined so that the spectral noise power density estimation error is reduced. The combination processor may combine the first estimate with the correction term to obtain a second estimate of the spectral noise power density that may be used for subsequent signal processing to enhance a desired signal component of the audio signal.

22 Claims, 7 Drawing Sheets

U.S. PATENT DOCUMENTS

| | | | | |
|---|---|---|---|---|
| 7,117,145 | B1 * | 10/2006 | Venkatesh et al. | 704/200 |
| 7,206,418 | B2 * | 4/2007 | Yang et al. | 381/92 |
| 7,224,810 | B2 * | 5/2007 | Brown | 381/94.3 |
| 7,302,065 | B2 * | 11/2007 | Furuta | 381/94.3 |
| 7,590,530 | B2 * | 9/2009 | Zhao et al. | 704/226 |
| 7,593,851 | B2 * | 9/2009 | Yang | 704/228 |
| 7,596,496 | B2 * | 9/2009 | Jabloun | 704/233 |
| 7,889,874 | B1 * | 2/2011 | Ayad | 381/94.2 |
| 7,912,231 | B2 * | 3/2011 | Yang et al. | 381/94.2 |
| 2003/0128851 | A1 | 7/2003 | Furuta | |
| 2003/0191637 | A1 * | 10/2003 | Deng et al. | 704/226 |
| 2004/0064307 | A1 * | 4/2004 | Scalart et al. | 704/205 |
| 2005/0240401 | A1 * | 10/2005 | Ebenezer | 704/226 |
| 2005/0278172 | A1 * | 12/2005 | Koishida et al. | 704/227 |
| 2006/0111154 | A1 | 5/2006 | Tran | |
| 2007/0027685 | A1 * | 2/2007 | Arakawa et al. | 704/226 |
| 2007/0033030 | A1 | 2/2007 | Gottesman | |
| 2007/0185711 | A1 * | 8/2007 | Jang et al. | 704/226 |
| 2007/0232257 | A1 * | 10/2007 | Otani et al. | 455/403 |
| 2008/0189104 | A1 * | 8/2008 | Zong et al. | 704/226 |
| 2008/0281589 | A1 * | 11/2008 | Wang et al. | 704/226 |
| 2008/0285774 | A1 * | 11/2008 | Kanamori et al. | 381/94.3 |
| 2008/0294430 | A1 * | 11/2008 | Ichikawa | 704/226 |
| 2009/0012783 | A1 * | 1/2009 | Klein | 704/226 |
| 2009/0024387 | A1 * | 1/2009 | Chandran et al. | 704/226 |
| 2009/0047003 | A1 * | 2/2009 | Yamamoto | 386/126 |
| 2009/0048824 | A1 * | 2/2009 | Amada | 704/10 |
| 2009/0254340 | A1 * | 10/2009 | Sun et al. | 704/226 |
| 2010/0076756 | A1 * | 3/2010 | Douglas et al. | 704/226 |
| 2010/0177916 | A1 * | 7/2010 | Gerkmann et al. | 381/317 |
| 2010/0182510 | A1 * | 7/2010 | Gerkmann et al. | 348/607 |
| 2011/0077939 | A1 * | 3/2011 | Jung et al. | 704/226 |
| 2011/0125494 | A1 * | 5/2011 | Alves et al. | 704/226 |

OTHER PUBLICATIONS

R. Martin, "Spectral Subtraction Based on Minimum Statistics," Proc. European Signal Processing Conference, pp. 1182-1185, Sep. 1994.*

R. Martin, "Bias Compensation Methods for Minimum Statistics Noise Power Spectral Density Estimation," Signal Processing vol. 86, 2006, pp. 1215-1229.*

Ephraim, Y. et al., "Speech Enhancement Using a Minimum Mean-Square Error Short-Time Spectral Amplitude Estimator," *IEEE Transactions on Acoustics, Speech and Signal Processing*, vol. ASSP-32, No. 6, 1984, pp. 1109-1121.

Hänsler, E. et al., *Audio Echo and Noise Control: A Practical Approach*, John Wiley & Sons, New York, New York, USA, copyright 2004, pp. 1-441.

Martin, R. et al., "Bias compensation methods for minimum statistics noise power spectral density estimation," *Signal*, Processing vol. 86, 2006, pp. 1215-1229.

Vary, P. et al., Chapter 6, "Linear Prediction," *Digital Speech Transmission: Enhancement, Coding and Error Concealment*, John Wiley & Sons, Ltd, Hoboken, NJ, USA, copyright 2006, pp. 163-199.

* cited by examiner

100

SYSTEM FOR SPEECH SIGNAL ENHANCEMENT IN A NOISY ENVIRONMENT THROUGH CORRECTIVE ADJUSTMENT OF SPECTRAL NOISE POWER DENSITY ESTIMATIONS

PRIORITY CLAIM

This application claims the benefit of priority from European Patent Application No. 07017134.3. filed Aug. 31, 2007. which is incorporated herein by reference.

BACKGROUND OF THE INVENTION

1. Technical Field

The present invention is directed to a system for enhancing a speech signal in a noisy environment through corrective adjustment of spectral noise power density estimations.

2. Related Art

Speech signals obtained through a microphone may include ambient noise. This noise may be added to the desired speech signal and may result in a corresponding distorted signal that includes both the desired speech signal and ambient noise signal. In hands free telephony, the distorted signal may include the voice signal, background noise, and echo components. In the case of a vehicle, the background noise may include the noise of the engine, the windstream, and the rolling tires. Unwanted signal components, such as echoes, may also be present in the distorted signal due to sound from loudspeakers connected to a radio and/or a hands-free telephony system.

A speech signal that includes noise may impair the use of the speech signal in some applications. The performance of speech recognition software may be diminished where the speech signal also includes noise. In hands free telephony applications, noise may reduce communication quality and intelligibility.

Noise reduction filters may be used to extract the desired speech signal from unwanted noise. The distorted signal may be split into frequency bands by a filter bank in the frequency domain. Noise reduction may then be performed in each frequency band separately. The filtered signal may be synthesized from the modified spectrum by a synthesizing filter bank, which transforms the signal back into the time domain.

Noise reduction filters may use estimates of the spectral power density of the distorted signal and of the noise component to extract the desired speech signal from the unwanted noise. Depending on the ratio of both quantities, a weighting factor may be applied in the distorted frequency band. The relationship between the spectral signal power and the weighting factor may be influenced by the filter characteristics. Filter performance may rely on an accurate estimate of the spectral noise power density. Inaccurate estimations of the spectral power density of the noise component may result in unwanted artifacts, including artifacts that may occur during interruptions in the speech signal.

SUMMARY

An apparatus for providing an estimate of the spectral noise power density of an audio signal includes a spectral noise power density estimation unit, a correction term processor, and a combination processor. The spectral noise power density estimation unit may provide a first estimate of the spectral noise power density of the audio signal. The correction term processor may provide a time dependent correction term based, at least in part, on a spectral noise power density estimation error of the actual spectral noise power density. The correction term may be determined so that the spectral noise power density estimation error is reduced. The combination processor may combine the first estimate with the correction term to obtain a second estimate of the spectral noise power density that may be used for subsequent signal processing to enhance a desired signal component of the audio signal.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The disclosed methods and apparatus can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
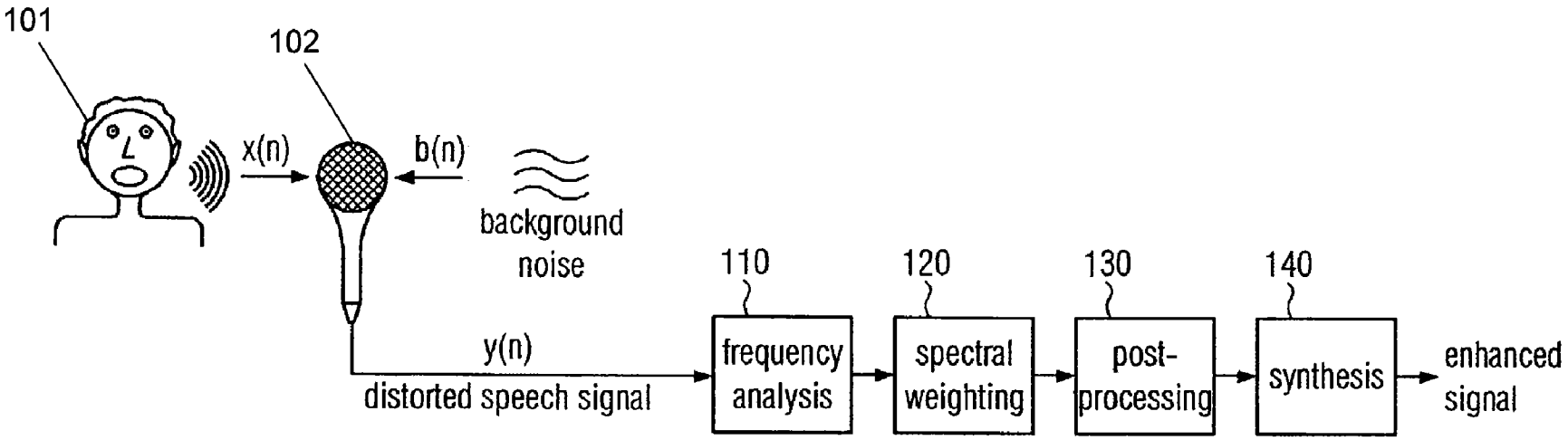
FIG. 1 is a system in which speech signals of a user are enhanced in a noisy environment through adjustment of spectral noise power density estimations.

FIG. 1 is a system 100 in which speech signals of a user 101 are enhanced in a noisy environment through adjustment of spectral noise power density estimations. System 100 includes one or more microphones 102 that are provided to transduce audio signals to electrical signals. A single microphone 102 is shown in system 100.

Microphone 102 may receive a speech signal x(n) generated by the user 101 as well as background noise b(n). These signals are superimposed on one another by the microphone 102 to generate a distorted signal y(n), where $$y(n)=x(n)+b(n).$$

The distorted signal y(n) therefore may include both the desired speech signal x(n) as well as the background noise signal b(n).

The distorted signal y(n) may be provided to a frequency analysis processor 110. The frequency analysis processor 110 may split the signal y(n) into corresponding overlapping blocks in the time domain. The length of each block may be application dependent, such as a length of 32 ms. Each block may then be transformed via a filter bank, discrete Fourier transform (DFT), or other time domain to frequency domain transform for transformation into the frequency domain. The frequency domain signal provided by the frequency analysis processor 110 may be provided to the input of a spectral weighting processor 120.

The spectral weighting processor 120 may weight each sub-band or frequency bin of the signal provided by the frequency analysis processor 110 with an attenuation factor. The attenuation factor may depend on the current signal-to-noise ratio. The spectral weighting processor 120 may be implemented in a number of ways. One filter configuration that may be used to facilitate removal of the noise component of the distorted signal y(t) is the Weiner filter. The Weiner filter may have the following frequency domain characteristics:

$$H(e^{j\Omega_\mu}, n) = 1 - \frac{S_{bb}(\Omega_\mu, n)}{S_{yy}(\Omega_\mu, n)}$$

Here, $S_{bb}(\Omega_\mu, n)$ denotes the spectral power density of the noise component b(n), $S_{yy}(\Omega_\mu, n)$ the spectral power density of the distorted signal y(n)=x(n)+b(n), and $\Omega_\mu$ denotes the frequency with frequency-index μ. The weighting factor computed according to this Wiener characteristic approaches 1 if the spectral power density of the distorted signal y(n) is greater than the spectral power density of the background noise b(n). In the absence of a speech signal component x(n), the spectral noise power density equals the spectral power density of the distorted signal y(n). In this latter case, $H(e^{j\Omega\mu}, n)=0$ and the filter is closed.

The portion of $S_{yy}(\Omega_\mu, n)$ that is due to noise may be estimated by the spectral weighting processor 120. A slowly varying estimate $\tilde{S}_{bb}(\Omega_\mu, n)$ may be generated that corresponds to the mean power of the noise component. The estimate $\tilde{S}_{bb}(\Omega_\mu, n)$ may show less fluctuation with respect to time than the spectral power density of the distorted signal $S_{yy}(\Omega_\mu, n)$.

The spectral noise power density of the distorted signal y(n) may be estimated using a faster varying signal to account for the faster varying power of the speech signal x(n). This may be achieved by smoothing the squared moduli. The filter characteristics of such a Wiener filter may correspond to the following form:

$$\tilde{H}(e^{j\Omega_\mu}, n) = 1 - \frac{\tilde{S}_{bb}(\Omega_\mu, n)}{S_{yy}(\Omega_\mu, n)}.$$

The spectral noise power density in this Wiener filter has been replaced by the estimated spectral noise power density.

Figure 3:
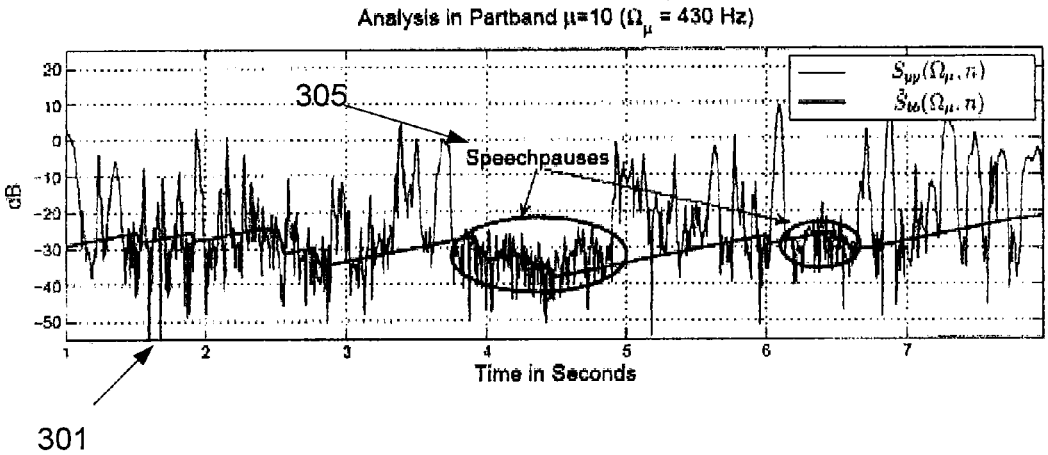
FIG. 3 shows the behavior of a filter without adjustment of spectral noise power density estimations.
Figure 3:
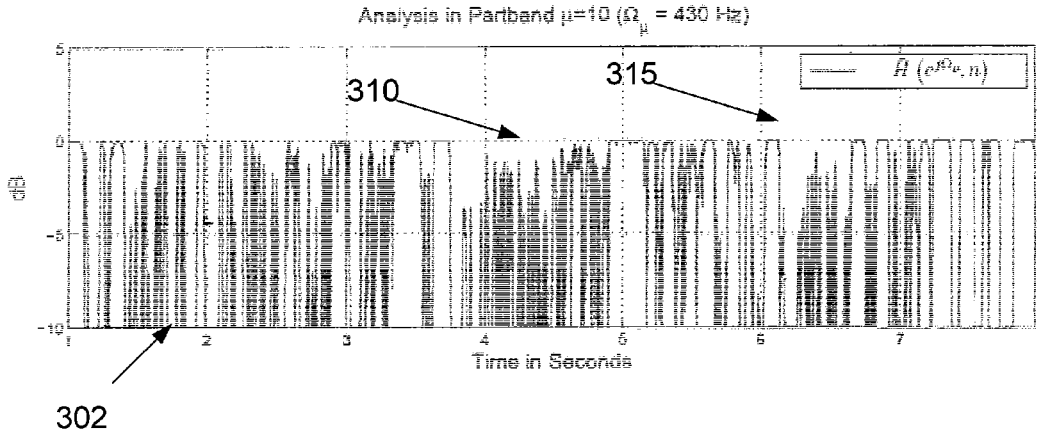

This Wiener filter architecture may result in a randomly fluctuating sub-band attenuation factor. Broadband background noise may be transformed into a signal comprised of short-lasting tones if no speech signal y(n) is present, e.g. during speech pauses. This behavior may result in "musical noise" or "musical tone" artifacts. FIG. 3 illustrates this behavior. Graph 301 of FIG. 3 shows the slowly varying spectral noise power density estimate $\tilde{S}_{bb}(\Omega_\mu, n)$ as well as the spectral power density of the distorted signal $S_{yy}(\Omega_\mu, n)$. During speech pauses, such as the ones shown at 305, $S_{yy}(\Omega_\mu, n)$ may fluctuate more than $\tilde{S}_{bb}(\Omega_\mu, n)$. As a result, the Wiener filter characteristic $\tilde{H}(e^{j\Omega\mu}, n)$ fluctuates during speech pauses as shown in 310 and 315 of graph 302. This statistical opening and closing of the filter may produce musical noise/tone artifacts.

The characteristics of $\tilde{S}_{bb}(\Omega_\mu, n)$ may be modified with an overweighting factor $\beta(\Omega_\mu)$ to facilitate reduction of these artifacts. The resulting Weiner filter characteristic may correspond to the following:

$$\overline{H}(e^{j\Omega_\mu}, n) = 1 - \beta(\Omega_\mu) \cdot \frac{\tilde{S}_{bb}(\Omega_\mu, n)}{S_{yy}(\Omega_\mu, n)}.$$

The choice of $\beta(\Omega_\mu)$ may reduce the unwanted artifacts. The filter, however, may not open properly during speech activity. Adaptive adjustment of the overweighting factor may also be used at the expense of additional memory and processing power.

In system 100, the frequency analysis processor 110 and/or spectral weighting processor 120 may individually and/or in cooperation with one another operate to provide an enhanced estimation of the actual spectral noise power density, designated here as $\hat{S}_{bb}(\Omega_\mu, n)$. To determine the value of $\hat{S}_{bb}(\Omega_\mu, n)$, system 100 operates to provide a first estimate of the spectral noise power density $\hat{S}_{bb}(\Omega_\mu, n)$ of the distorted signal y(n). A time dependent correction factor $K(\Omega_\mu, n)$ is derived and used with the first estimate of the spectral noise power density $\tilde{S}_{bb}(\Omega_\mu, n)$ to generate the enhanced value of $\hat{S}_{bb}(\Omega_\mu, n)$.

The enhanced value $\hat{S}_{bb}(\Omega_\mu, n)$ may be used in a filter, such as a Weiner filter, to recover the speech signal x(n) from the distorted signal y(n). The resulting filtered signal may facilitate reduction of artifacts, such as those that may occur during pauses in the speech signal x(n).

The correction factor $K(\Omega_\mu, n)$ may be derived using a spectral power density estimation error. The derivation may result in a correction factor $K(\Omega_\mu, n)$ having a small value when the value of the estimation error is small. The correction factor $K(\Omega_\mu, n)$ may be used in a number of manners. An overall correction term may be obtained based on the product of the correction factor $K(\Omega_\mu, n)$ and the spectral power density estimation error. When this form of a correction term is used, the estimate of the spectral noise power density $\hat{S}_{bb}(\Omega_\mu, n)$ may be determined using the following equation:

$$\hat{S}_{bb}(\Omega_\mu, n)=\tilde{S}_{bb}(\Omega_\mu, n)+K(\Omega_\mu, n)\cdot E_p(\Omega_\mu, n),$$

where $\tilde{S}_{bb}(\Omega_\mu, n)$ corresponds to the first estimate of the spectral noise power density, $\hat{S}_{bb}(\Omega_\mu, n)$ corresponds to a second, enhanced estimate of the spectral power density, $E_p(\Omega_\mu, n)$ corresponds to the spectral power density estimation error, and $K(\Omega_\mu, n)$ corresponds the correction factor. The value n corresponds to the time variable and $\Omega_\mu$ corresponds to the frequency variable with frequency-index μ. The frequency variable $\Omega_\mu$ may be based on frequency supporting points in the frequency bands of the frequency domain signal. The frequency supporting points $\Omega_\mu$ may be equally spaced or may be distributed non-uniformly. This determination of the correction factor $K(\Omega_\mu, n)$ provides a way to adapt the correction factor $K(\Omega_\mu, n)$ so that the spectral noise power density estimation error is reduced.

The correction factor $K(\Omega_\mu, n)$ may be based on the expectation value of the squared difference of the actual spectral noise power density estimation error and the first estimate of the spectral noise power density of the distorted signal, and on the expectation value of the squared spectral power density of the speech signal component. This may be realized when the correction factor $K(\Omega_\mu, n)$ has the following form:

$$K(\Omega_\mu, n) = \frac{E\{E_n^2(\Omega_\mu, n)\}}{E\{E_p^2(\Omega_\mu, n)\}} = \frac{E\{E_n^2(\Omega_\mu, n)\}}{E\{E_n^2(\Omega_\mu, n)\} + E\{S_{xx}^2(\Omega_\mu, n)\}}.$$

where $E\{.\}$ corresponds to the operation of determining the expectation value, $S_{xx}(\Omega_\mu, n)$ corresponds to the spectral power density of the desired speech signal component, and $$E_n(\Omega_\mu, n) = S_{bb}(\Omega_\mu, n) - S_{bb}(\Omega_\mu, n).$$

The spectral noise power density estimation error may be based on the deviation of the second, enhanced estimate of the spectral noise power density $\hat{S}_{bb}(\Omega_\mu, n)$ from the actual spectral noise power density of the distorted signal. The deviation may be based on a difference and/or a metric. The spectral noise power density estimation error may have the form:

$$E\{\hat{E}_n^2(\Omega_\mu, n)\},$$

with $\hat{E}_n(\Omega_\mu, n) = S_{bb}(\Omega_\mu, n) - \hat{S}_{bb}(\Omega_\mu, n)$. If this error is reduced, the second, enhanced estimate of the spectral noise power density $\hat{S}_{bb}(\Omega_\mu, n)$ is closer to the actual spectral noise power density.

The correction factor $K(\Omega_\mu, n)$ may be based on the variance of the relative spectral noise power density estimation error, on the first estimate of the spectral noise power density of the distorted signal, and on the actual spectral power density of the distorted signal. Using these values, the correction factor may have the form:

$$K(\Omega_\mu, n) = \frac{\sigma_{E_{nrel}}^2 \cdot \tilde{S}_{bb}^2(\Omega_\mu, n)}{\left(S_{yy}(\Omega_\mu, n) - \tilde{S}_{bb}(\Omega_\mu, n)\right)^2},$$

where $\sigma_{E_{nrel}}^2$ denotes the variance of the error $E_{nrel}$ in relation to $\tilde{S}_{bb}(\Omega_\mu, n)$, e.g. $\sigma_{E_{nrel}}^2 = \sigma_{E_n}^2 / \tilde{S}_{bb}(\Omega_\mu, n)$, and $S_{yy}(\Omega_\mu, n)$ denotes the spectral power density of the distorted signal y(n). In this form, the variance of the relative error estimate may experience small fluctuations and result in an accurate estimate of the actual spectral noise power density.

In system 100, the distorted signal y(n) includes both the speech signal x(n) and noise b(n). The relative spectral noise power density estimation error may be determined when the speech signal x(n) is not present in signal y(n). The presence or absence of the speech signal x(n) may be detected using a voice activity detector.

The first estimate of the spectral noise power density $\tilde{S}_{bb}(\Omega_\mu, n)$ may be a mean noise power density. The mean noise power density may correspond to a moving average. Additionally, or in the alternative, the first estimate of the spectral noise power density $\tilde{S}_{bb}(\Omega_\mu, n)$ may be determined using a minimum statistics method and/or a minimum tracking method.

The output of the spectral weighting processor 120 may be communicated to an optional post-processing unit 130. The post-processing unit 130 may execute operations including pitch adaptive filtering, automatic gain control, or any signal manipulation process. The resulting frequency domain representation of the enhanced signal spectrum may be transformed into the time domain in synthesis processor 140. The output of the synthesis processor 140 corresponds to the enhanced speech signal.

System 100 may be preceded or followed by further filtering and/or signal processing units. The input signal may be the result of processing operations performed by processing units such as a beamformer, one or more band-pass filters, an echo-cancellation component, and/or other signal processing unit. The output signal may be processed by processing units such as a filter component, a gain control component, and/or other signal processing unit.

Figure 2:
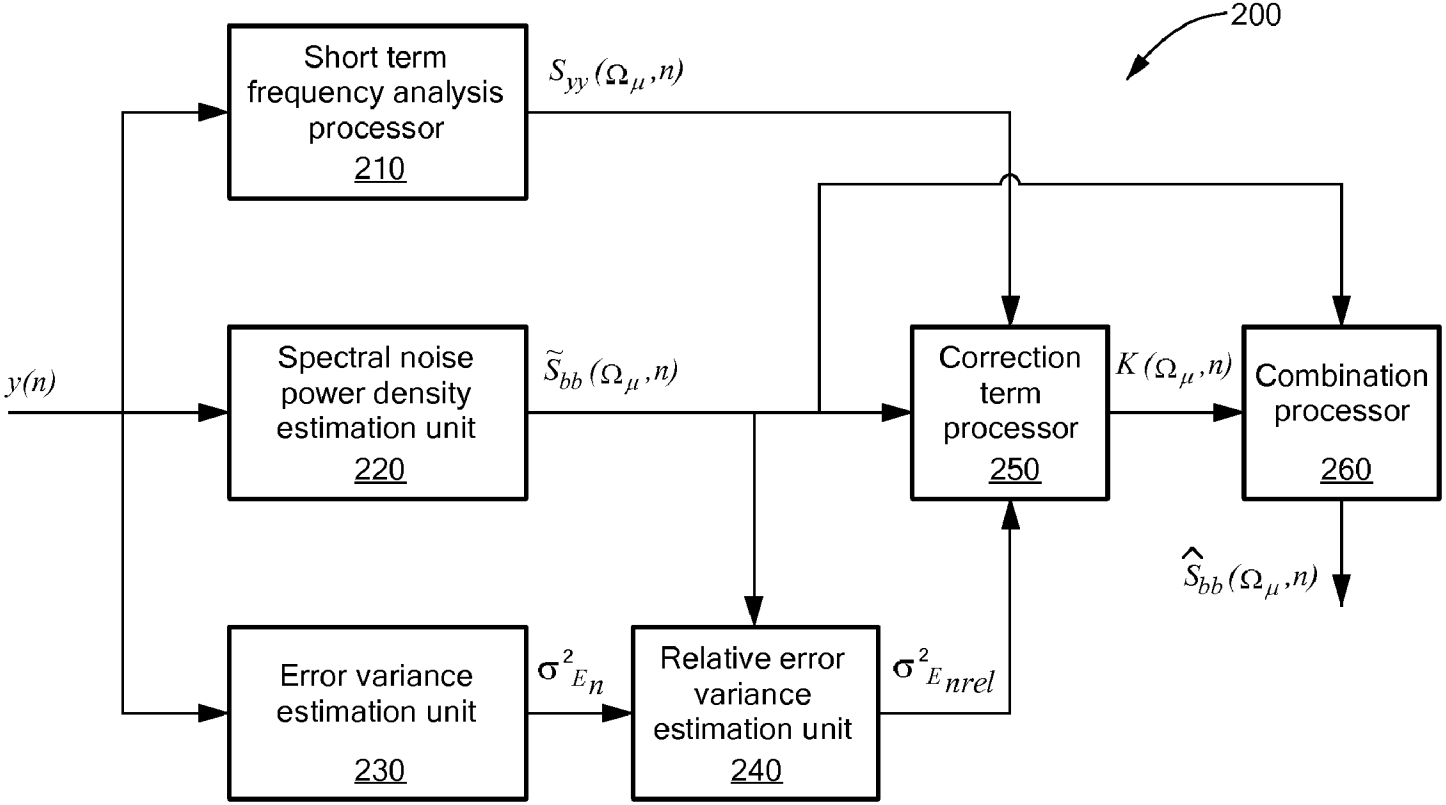
FIG. 2 is a system that may be used by the frequency analysis processor and/or spectral weighting processor shown in FIG. 1.

FIG. 2 is a system 200 that may be used by the frequency analysis processor 110 and/or spectral weighting processor 120 to provide values for the varying estimate of the spectral noise power density $\hat{S}_{bb}(\Omega_\mu, n)$ that accurately correspond to the actual spectral noise power density. In system 200, the audio signal y(n) is communicated to an input of a short-term frequency analysis unit 210. The short-term frequency analysis unit 210 provides values $S_{yy}(\Omega_\mu, n)$ that correspond to the spectral power density of the signal y(n). A fast Fourier transform (FFT) may be applied to the signal y(n) pursuant to calculating the values of $S_{yy}(\Omega_\mu, n)$. The FFT may be applied to overlapping signal segments. The segmentation may involve extraction of the last M samples of the input signal y(n). Successive blocks may overlap by any amount, such as 50% or 75%. Each segment may be multiplied by a windowing function. In short-time frequency analysis, the frequency-domain signal may include frequency bands characterized by frequency supporting points $\Omega_\mu$. The frequency supporting points $\Omega_\mu$ may be equidistant over a normalized frequency range in accordance with the following equation:

$$\Omega_\mu = \frac{2\pi}{M}\mu \text{ with } \mu \in \{0, \ldots, M-1\}.$$

The number M of frequency supporting points may be any number, such as 256.

Additionally or in the alternative, the frequency supporting points may be non-uniformly distributed.

The distorted signal y(n) may also be provided to a spectral noise power density estimation unit 220. The spectral noise power density estimation unit 220 may provide a first estimate of the spectral noise power density $\tilde{S}_{bb}(\Omega_\mu, n)$ of the distorted signal y(n). The output of the spectral noise power density estimation unit 220 may be a slowly varying estimate of the spectral noise power density, which may correspond to the mean power of the background noise b(n). Minimum statistics or minimum tracking may be used to determine this first estimate of the spectral noise power density $\tilde{S}_{bb}(\Omega_\mu, n)$.

The distorted signal y(n) may also be communicated to an error variance estimation unit 230, which estimates the variance of the error $\sigma_{E_n}^2$. This estimation may be performed when y(n) does not include the speech component x(n), e.g., during speech pauses.

The output of the error variance estimation unit 230 and the output of spectral noise power density estimation unit 220 may be communicated to the input of a relative error variance estimation unit 240. The relative error variance estimation unit 240 estimates the variance of the relative error $\sigma_{E_{nrel}}^2$ by computing $\sigma_{E_{nrel}}^2 = \sigma_{E_{nrel}}^2 / \tilde{S}_{bb}(\Omega_\mu, n)$. The value of $\sigma_{E_{nrel}}^2$ may be calculated in the absence of a speech signal x(n), e.g. during speech pauses.

The correction factor $K(\Omega_\mu, n)$ may be determined by a correction factor processor 250. The correction factor processor 250 determines the correction factor $K(\Omega_\mu, n)$ based on the variance of the relative spectral noise power density estimation error $\sigma_{E_{nrel}}^2$, on the first estimate of the spectral noise power density of the distorted signal $\tilde{S}_{bb}(\Omega_\mu, n)$, and on the actual spectral signal power density of the distorted signal $S_{yy}(\Omega_\mu, n)$. The correction factor $K(\Omega_\mu, n)$ may be determined using the following equation:

$$K(\Omega_\mu, n) = \frac{\sigma^2_{E_{nrel}} \cdot \tilde{S}^2_{bb}(\Omega_\mu, n)}{\left(S_{yy}(\Omega_\mu, n) - \tilde{S}_{bb}(\Omega_\mu, n)\right)^2}$$

The estimate of the spectral noise power density $\hat{S}_{bb}(\Omega_\mu, n)$ of the distorted signal y(n) is determined by a combination processor 260. The combination processor 260 receives the correction factor $K(\Omega_\mu, n)$ and first estimate of the spectral noise power density $\hat{S}_{bb}(\Omega_\mu, n)$. The values of the correction factor $K(\Omega_\mu, n)$ and the first estimate of the spectral noise power density $\hat{S}_{bb}(\Omega_\mu, n)$ may be added to one another in the combination processor 260 to provide an estimate of the spectral noise power density $\hat{S}_{bb}(\Omega_\mu, n)$ having the following form:

$$\begin{aligned}\hat{S}_{bb}(\Omega_\mu, n) &= \tilde{S}_{bb}(\Omega_\mu, n) + \frac{\sigma^2_{E_{nrel}} \cdot \tilde{S}^2_{bb}(\Omega_\mu, n)}{S_{yy}(\Omega_\mu, n) - \tilde{S}_{bb}(\Omega_\mu, n)} \\ &= \tilde{S}_{bb}(\Omega_\mu, n) + K(\Omega_\mu, n).\end{aligned}$$

The spectral noise power density estimate $\hat{S}_{bb}(\Omega_\mu, n)$ may be used instead of the first spectral noise power density estimate $\tilde{S}_{bb}(\Omega_\mu, n)$ in connection with various signal processing methods and filters. Such processing may include power and amplitude SPS, Wiener filters, and other the speech enhancement operations.

Figure 4:
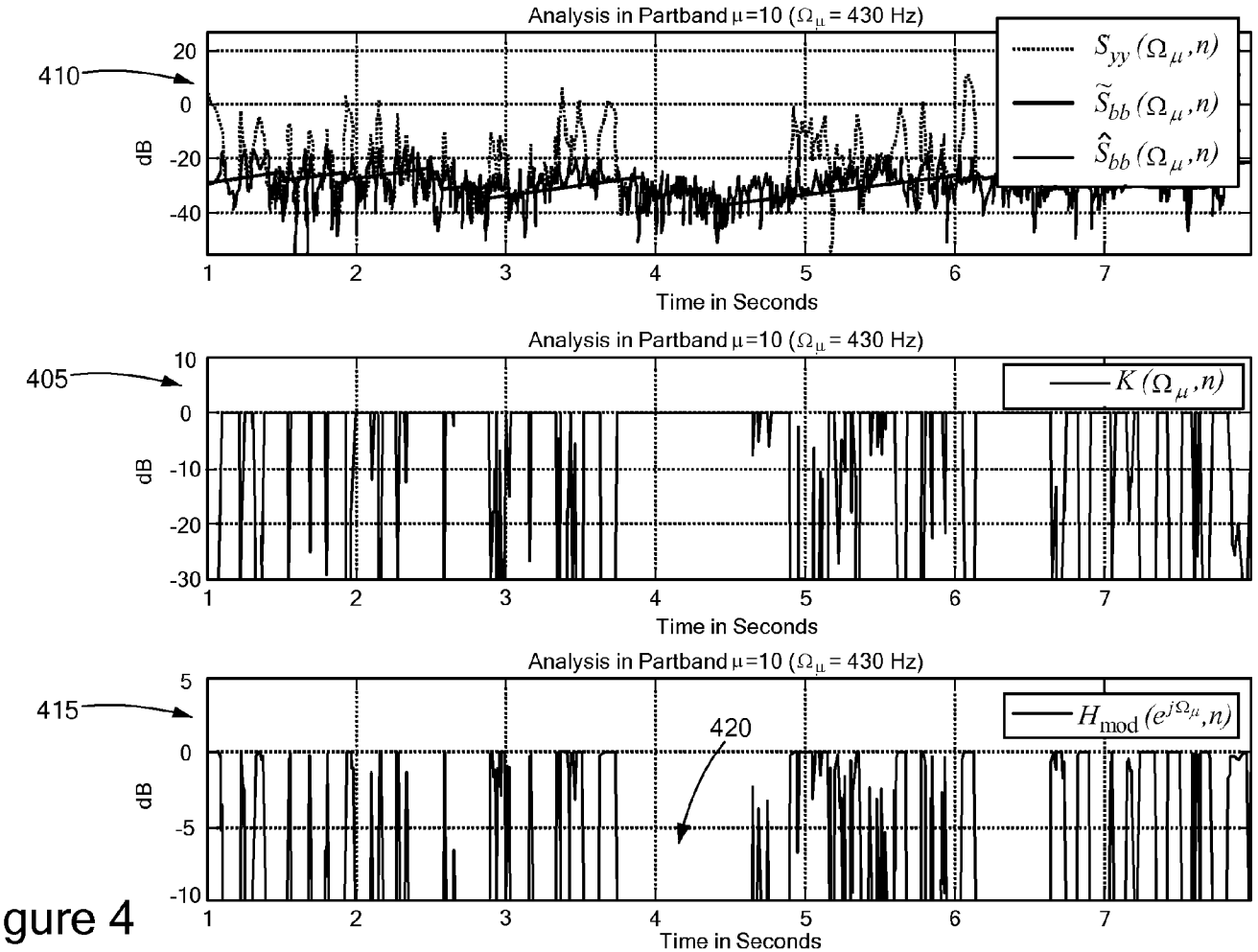
FIG. 4 shows the behavior of a filter where the spectral noise power density estimations include a correction term.

An example of the operation of a filter in which the correction factor $K(\Omega_\mu, n)$ is used to determine the spectral noise power density value $\hat{S}_{bb}(\Omega_\mu, n)$ is shown in FIG. 4. The graph 405 of FIG. 4 shows the correction factor $K(\Omega_\mu, n)$ as a function of time. A correction may take place in the absence of the speech signal component x(n), e.g., during speech pauses. Graph 410 of FIG. 4 shows $S_{yy}(\Omega_\mu, n)$, and $\tilde{S}_{bb}(\Omega_\mu, n)$ as a function of time. As can be seen, during speech pauses, the spectral noise power density estimate $\hat{S}_{bb}(\Omega_\mu, n)$ closely follows the spectral power density $S_{yy}(\Omega_\mu, n)$ of the distorted signal y(n) as compared with $\tilde{S}_{bb}(\Omega_\mu, n)$.

The modified filter characteristics of a Wiener filter, based on the second estimate of the spectral noise power density $\hat{S}_{bb}(\Omega_\mu, n)$ may take the form:

$$H_{mod}(e^{j\Omega_\mu}, n) = 1 - \frac{\tilde{S}_{bb}(\Omega_\mu, n)}{S_{yy}(\Omega_\mu, n)} - \frac{\sigma^2_{E_{nrel}} \cdot \tilde{S}^2_{bb}(\Omega_\mu, n)}{S^2_{yy}(\Omega_\mu, n) - \tilde{S}_{bb}(\Omega_\mu, n) \cdot S_{yy}(\Omega_\mu, n)}.$$

The last part of the sum is a result of the application of the correction factor $K(\Omega_\mu, n)$. An example of the characteristics $H_{mod}(\Omega_\mu, n)$ of this filter as a function of time is shown at graph 415 of FIG. 4. As shown, the filter is substantially closed at 420 in the absence of a speech signal component x(n), i.e. during speech pauses.

The Wiener filter characteristics may be further modified by introducing frequency-dependent and/or time-dependent weighting factors, such that the characteristics may correspond to the following form:

$$H_{mod}(e^{j\Omega_\mu}, n) = 1 - \alpha(\Omega_\mu, n)\frac{\tilde{S}_{bb}(\Omega_\mu, n)}{S_{yy}(\Omega_\mu, n)} - \beta(\Omega_\mu, n)\frac{\sigma^2_{E_{nrel}} \cdot \tilde{S}^2_{bb}(\Omega_\mu, n)}{S^2_{yy}(\Omega_\mu, n) - \tilde{S}_{bb}(\Omega_\mu, n) \cdot S_{yy}(\Omega_\mu, n)}$$

In this filter form, the coefficients $\alpha$ and $\beta$ ay depend on frequency and/or time.

Figure 5:
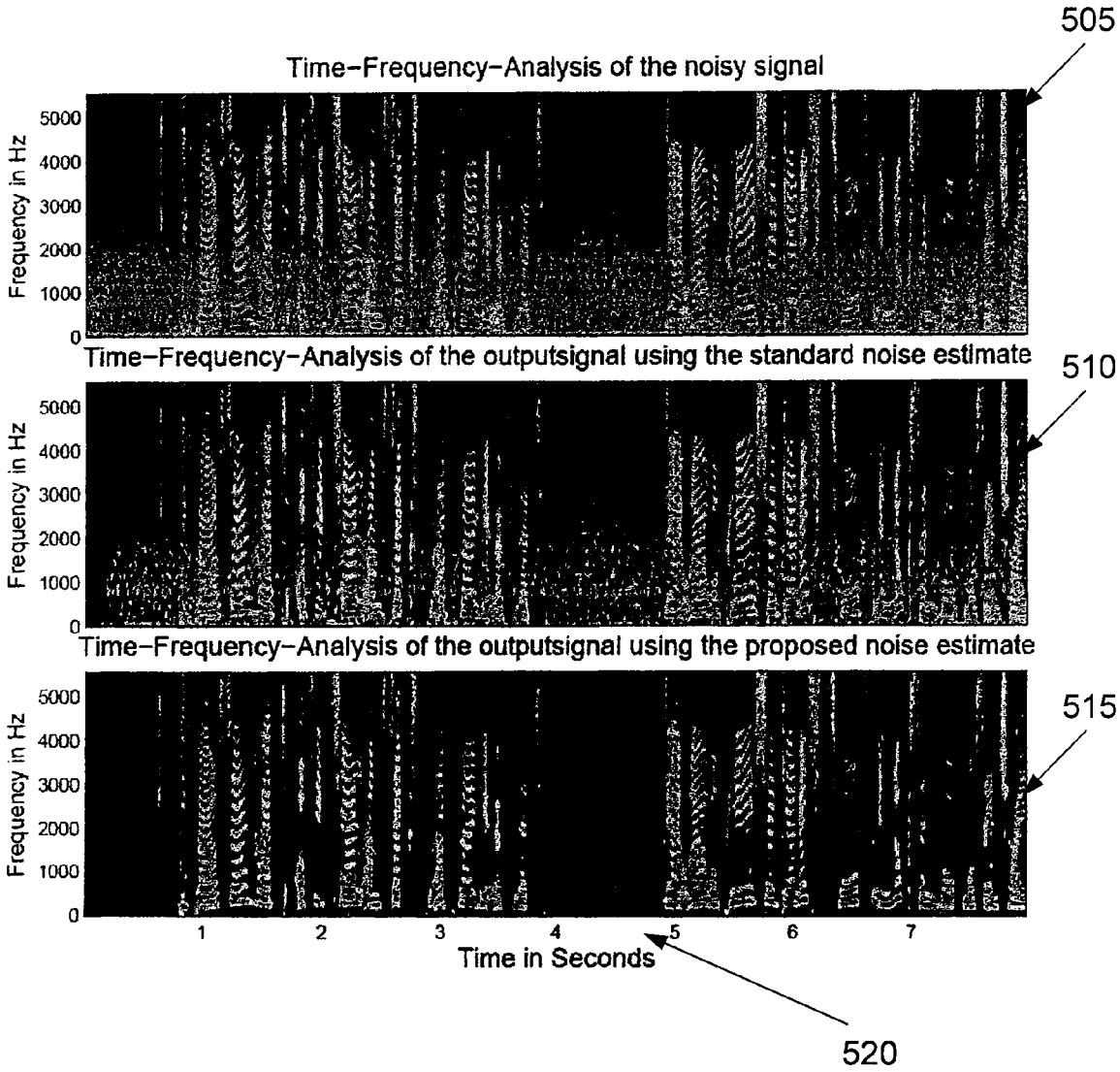
FIG. 5 shows spectrographs comparing filter responses with and without modified spectral noise power density estimations.

Spectrographs of a Wiener filter are shown in FIG. 5. Spectrograph 505 shows the time-frequency analysis of a distorted signal. Spectrograph 510 shows the noise-reduced speech signal without the use of a correction factor, e.g., a plain Wiener filter with characteristic $\tilde{H}(e^{j\Omega_\mu}, n)$. During speech pauses, artifacts (e.g., musical noise) are still present in spectrograph 510. The spectrograph 515 shows the filtered speech signal as processed by a modified Wiener filter $H_{mod}(e^{j\Omega_\mu}, n)$ employing correction factor $K(\Omega_\mu, n)$. The artifacts during speech pauses are substantially reduced in spectrograph 515, such as at region 520, compared to the spectrograph 510 using the unmodified Wiener filter.

Figure 6:
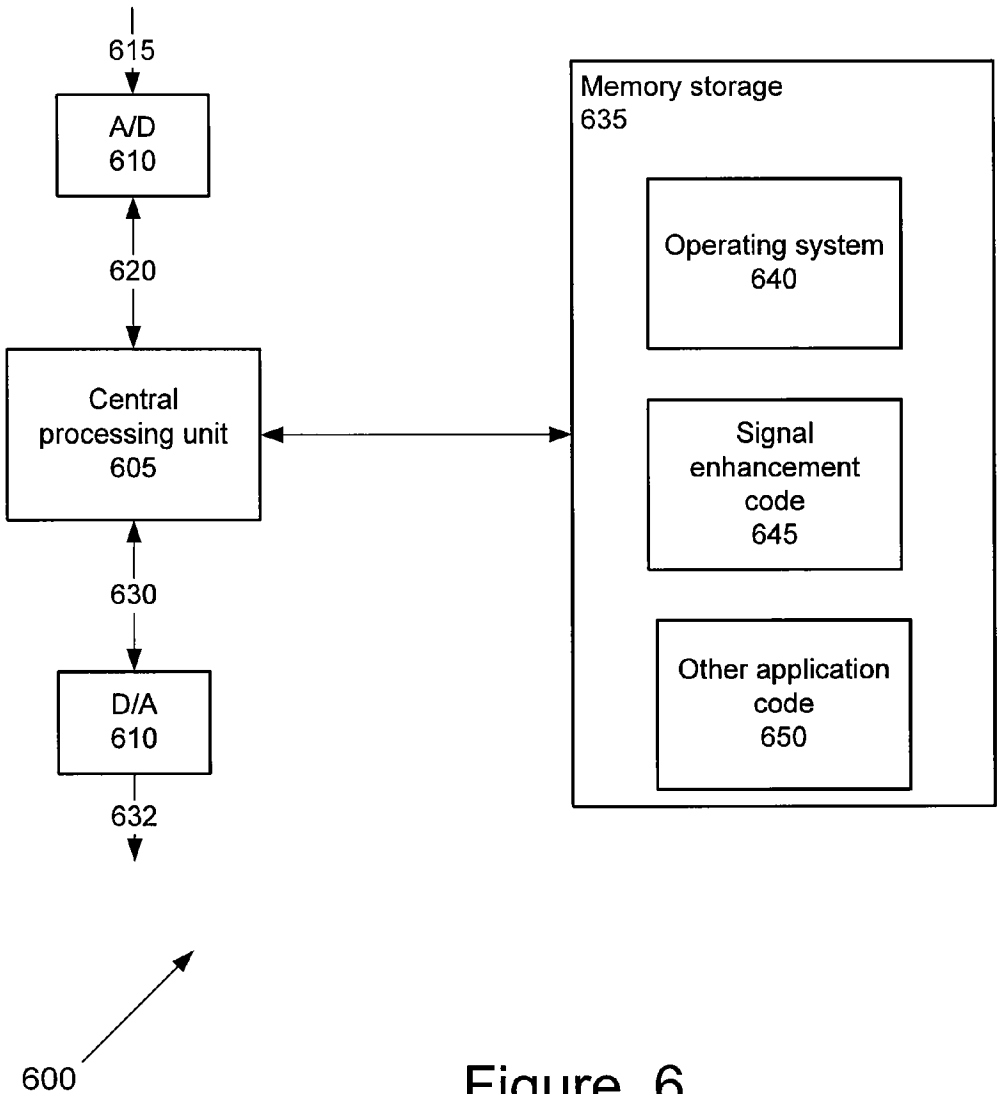
FIG. 6 is a processing system that may implement the systems shown in FIG. 1 and/or FIG. 2.

FIG. 6 is a processing system 600 that may implement system 100. Processing system 600 may include one or more central processing units 605. The central processing unit 605 may include a single processor or multiple processors. Multiple processors may be in communication with one another in a symmetric multiprocessing environment. Additionally, or in the alternative, the central processing unit 605 may include one or more digital signal processors.

The central processing unit 605 may be in communication with an analog-to-digital converter 610. The analog-to-digital converter 610 may receive a distorted time domain signal 615 that includes a desired signal, such as a speech signal, and undesired background noise. Digital representations of the time domain signal 615 may be provided to the central processing unit 605 at 620.

The central processing unit 605 may also be in communication with a digital-to-analog converter 625. Digital signals corresponding to an enhanced signal, such as an enhanced speech signal, may be communicated from the central processing unit 605 to the digital-to-analog converter 625 at 630. The output of the digital-to-analog converter 625 may be an analog signal at 632 that corresponds to the enhanced signal provided by the central processing unit 605.

System 600 may also include memory storage 635. Memory storage 635 may include an individual memory storage unit, multiple memory storage units, networked memory storage, volatile memory, non-volatile memory, and/or other memory storage types and arrangements. Memory storage 635 may include code that is executable by the central processing unit 605. The executable code may include operating system code 640, signal enhancement code 645, as well as other program code 650. Signal enhancement code 645 may be executed to direct the signal processing operations used to enhance the signal provided at 615. Program code 650 may include application code such as speech processing and/or other application code used to implement the functions of system 600.

Figure 7:
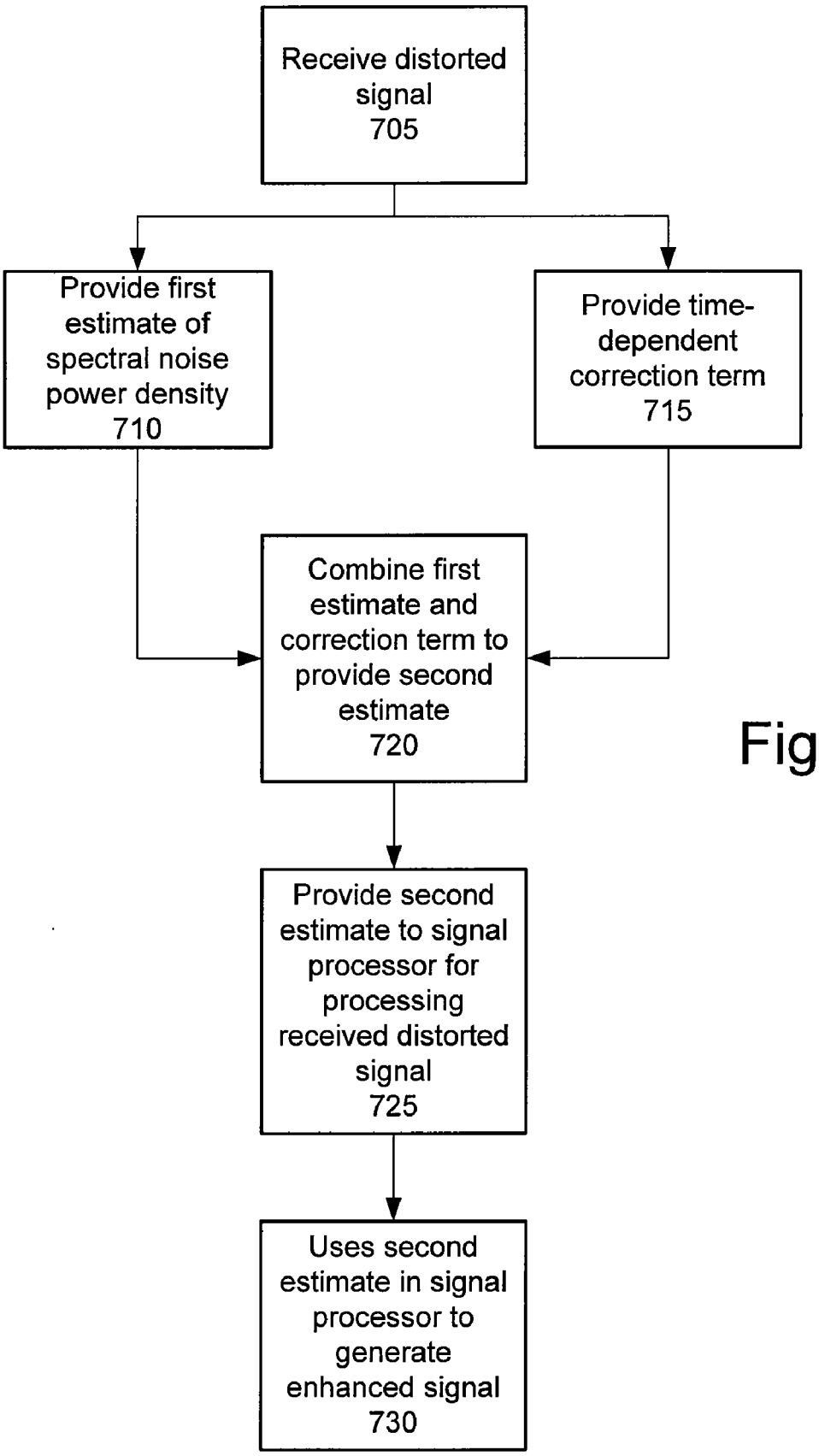
FIG. 7 is a process for providing an enhanced signal, such as a speech signal, from a signal that is distorted by background noise.

FIG. 7 is a process for providing an enhanced signal, such as a speech signal, from a signal that is distorted by background noise. At 705, the process receives the distorted signal that is to be enhanced to reduce the amount of background noise. A first estimate of the spectral noise power density of the distorted signal is determined at 710. A time dependent correction term for providing the enhanced signal is generated at 715. The time dependent correction term may include a time dependent correction factor. In some processes, the time the dependent correction term may be the time dependent correction factor. At 720, the first estimate and the correction factor are used to obtain a second estimate of the spectral noise power density of the distorted signal. The second estimate may be obtained by adding the correction term to the first estimate. At 725, the process provides the second estimate to a signal processor, such as a filter. The second estimate is used by the signal processor at 730 to generate the enhanced signal, such as an enhanced speech signal.

The methods and descriptions above may be encoded in a signal bearing medium, a computer readable medium or a computer readable storage medium such as a memory that may comprise unitary or separate logic, programmed within a device such as one or more integrated circuits, or processed by a controller or a computer. If the methods are performed by software, the software or logic may reside in a memory resident to or interfaced to one or more processors or controllers, a wireless communication interface, a wireless system, a powertrain controller, an entertainment and/or comfort controller of a vehicle or non-volatile or volatile memory remote from or resident to a the system. The memory may retain an ordered listing of executable instructions for implementing logical functions. A logical function may be implemented through digital circuitry, through source code, through analog circuitry, or through an analog source such as through an analog electrical, or audio signals. The software may be embodied in any computer-readable medium or signal-bearing medium, for use by, or in connection with an instruction executable system or apparatus resident to a vehicle or a hands-free or wireless communication system. Alternatively, the software may be embodied in media players (including portable media players) and/or recorders. Such a system may include a computer-based system, a processor-containing system that includes an input and output interface that may communicate with an automotive or wireless communication bus through any hardwired or wireless automotive communication protocol, combinations, or other hardwired or wireless communication protocols to a local or remote destination, server, or cluster. Although the foregoing systems have been described in the context of speech enhancement, the systems may be used in any application in which signal enhancement in background noise is beneficial.

A computer-readable medium, machine-readable medium, propagated-signal medium, and/or signal-bearing medium may comprise any medium that contains, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical or tangible connection having one or more links, a portable magnetic or optical disk, a volatile memory such as a Random Access Memory "RAM" (electronic), a Read-Only Memory "ROM," an Erasable Programmable Read-Only Memory (EPROM or Flash memory), or an optical fiber. A machine-readable medium may also include a tangible medium upon which software is printed, as the software may be electronically stored as an image or in another format (e.g., through an optical scan), then compiled by a controller, and/or interpreted or otherwise processed. The processed medium may then be stored in a local or remote computer and/or a machine memory.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A method for providing an estimate of a spectral noise power density of an audio signal, comprising:

providing a first estimate of the spectral noise power density of the audio signal $\tilde{S}_{bb}$;

determining a time dependent correction term based, at least in part, on a spectral noise power density estimation error of the spectral noise power density $E_n$;

summing the first estimate $\tilde{S}_{bb}$ and the correction term to obtain a second estimate of the spectral noise power density of the audio signal $\hat{S}_{bb}$;

where the correction term is determined so that the spectral noise power density estimation error $E_n$ is reduced, and where $E_n$ is determined by at least one of $E_n=S_{bb}-\tilde{S}_{bb}$ and $E_n=S_{bb}-\hat{S}_{bb}$ ,where $S_{bb}$ corresponds to the spectral noise power density of the audio signal, where the audio signal comprises a wanted signal component and a noise component, and where the correction term is based on:

an expectation value of the squared difference of the spectral noise power density and the first estimate of the spectral noise power density of the audio signal $\hat{S}_{bb}$, and an expectation value of the squared spectral power density of the wanted signal component.

2. The method of claim 1, where the correction term comprises a product of a correction factor K and a spectral power density estimation error $E_p$.

3. The method of claim 1, where the correction term is based, at least in part, on values comprising:

a variance of a relative spectral noise power density estimation error $\sigma_{E_{rel}}^2$;

the first estimate of the spectral noise power density of the audio signal $\tilde{S}_{bb}$; and the spectral signal power density of the audio signal $S_{yy}$.

4. The method of claim 3, where the audio signal comprises a wanted signal component and a noise component, and where the relative spectral noise power density estimation error is determined when the wanted signal component is not present in the audio signal.

5. The method of claim 1, where the first estimate of the spectral noise power density $\tilde{S}_{bb}$ is a mean noise power density.

6. The method of claim 1, where the first estimate of the spectral noise power density $\tilde{S}_{bb}$ is determined based, at least in part, on a minimum statistics method or a minimum tracking method.

7. The method of claim 1, further comprising:

providing the second estimate $\hat{S}_{bb}$ for use by a filter; and filtering the audio signal based on the second estimate of the spectral noise power density $\hat{S}_{bb}$.

8. The method of claim 7, where the filtering is performed using a Wiener filter having a filter characteristic based on the second estimate of the spectral noise power density of the audio signal $\hat{S}_{bb}$.

9. The method of claim 7, where the filtering is performed using a minimal subtraction filter having a filter characteristic based on the second estimate of the spectral noise power density of the audio signal $\hat{S}_{bb}$.

10. A non-transitory computer readable medium including computer executable code for executing a method providing an estimate of a spectral noise power density of an audio signal, the method comprising:

providing a first estimate of the spectral noise power density of the audio signal $\tilde{S}_{bb}$;

determining a time dependent correction term based, at least in part, on a spectral noise power density estimation error of the spectral noise power density $E_n$;

summing the first estimate $\tilde{S}_{bb}$ and the correction term to obtain a second estimate of the spectral noise power density of the audio signal $\hat{S}_{bb}$;

where the correction term is determined so that the spectral noise power density estimation error $E_n$ is reduced, and where $E_n$ is determined by at least one of $E_n=S_{bb}-\tilde{S}_{bb}$ and $E_{bb-\hat{S}bb}$, where $S_{bb}$ corresponds to the spectral noise power density of the audio signal, where the audio signal comprises a wanted signal component and a noise component, and where the correction term is based on:

an expectation value of the squared difference of the spectral noise power density and the first estimate of the spectral noise power density of the audio signal $\hat{S}_{bb}$, and an expectation value of the squared spectral power density of the wanted signal component.

11. The computer readable medium of claim 10, where the correction term comprises a product of a correction factor K and a spectral power density estimation error$E_p$.

12. The computer readable medium of claim 10, where the correction term is based, at least in part, on values comprising:

a variance of a relative spectral noise power density estimation error $\sigma_{E_{nrel}}{}^2$;

the first estimate of the spectral noise power density of the audio signal$\tilde{S}_{bb}$; *and* and a spectral signal power density of the audio signal $S_{yy}$.

13. The computer readable medium of claim 12, where the audio signal comprises a wanted signal component and a noise component, and where the relative spectral noise power density estimation error is determined when the wanted signal component is not present in the audio signal.

14. The computer readable medium of claim 10, where the first estimate of the spectral noise power density $\tilde{S}_{bb}$ is a mean noise power density.

15. The computer readable medium of claim 10, where the first estimate of the spectral noise power density $\tilde{S}_{bb}$ is determined based, at least in part, on a minimum statistics method or a minimum tracking method.

16. The computer readable medium of claim 10, where the method further comprises:

providing the second estimate $\tilde{S}_{bb}$ for use by a filter; and filtering the audio signal based on the second estimate of the spectral noise power density $\hat{S}_{bb}$.

17. The computer readable medium of claim 16, where the filtering is performed using a Wiener filter having a filter characteristic based on the second estimate of the spectral noise power density of the audio signal $\hat{S}_{bb}$.

18. The computer readable medium of claim 16, where the filtering is performed using a minimal subtraction filter having a filter characteristic based on the second estimate of the spectral noise power density of the audio signal $\hat{S}_{bb}$.

19. An apparatus for providing an estimate of a spectral noise power density of an audio signal comprising:

a spectral noise power density estimation unit adapted to provide a first estimate of the spectral noise power density of the audio signal $\tilde{S}_{bb}$;

a correction term processor adapted to provide a time dependent correction term based, at least in part, on a spectral noise power density estimation error of the spectral noise power density $E_n$;

a combination processor for summing the first estimate $\tilde{S}_{bb}$ and the correction term to obtain a second estimate of the spectral noise power density of the audio signal $\hat{S}_{bb}$;

where the correction term processor is adapted to determine the correction term so that the spectral noise power density estimation error $E_n$ is reduced, and where $E_n$ is determined by at least one of $E_n=S_{bb}\ \tilde{S}_{bb}$ and $E_n=S_{bb}-\hat{S}_{bb}$, where $S_{bb}$ corresponds to the spectral noise power density of the audio signal, where the audio signal comprises a wanted signal component and a noise component, and where the correction term is based on:

an expectation value of the squared difference of the spectral noise power density and the first estimate of the spectral noise power density of the audio signal $\hat{S}_{bb}$, and an expectation value of the squared spectral power density of the wanted signal component.

20. The apparatus of claim 19, further comprising a short-term frequency analysis unit adapted to provide an estimate of the current spectral power density of the audio signal.

21. A non-transitory computer readable medium including computer executable code for executing a method providing an estimate of a spectral noise power density of an audio signal having a wanted signal component and a noise component, the method comprising:

providing a first estimate of the spectral noise power density of the audio signal $\tilde{S}_{bb}$;

determining a time dependent correction term that is a product of a correction factor K and a spectral power density estimation error $E_p$, wherein $$K=(E\{E_n^2\})/((E\{E_n^2\})+E\{S_{xx}^2\}),$$

where E{ } corresponds to an operation of determining expection, where $E_n$ corresponds to a spectral noise power density estimation error of the spectral noise power density $E_{n=Sbb}-\tilde{S}_{bb}$, where $S_{bb}$ corresponds to spectral noise power density, and where $S_{xx}$ corresponds to a spectral power density of the wanted signal component; and combining the first estimate $\tilde{S}_{bb}$ and the correction term to obtain a second estimate of the spectral noise power density of the audio signal $\hat{S}_{bb}$:

$$\hat{S}_{bb}=\tilde{S}_{bb}+KE_p,$$

wherein the correction term is determined so that the spectral noise power density estimation error $E_n$ is reduced.

22. A non-transitory computer readable medium including computer executable code for executing a method providing an estimate of a spectral noise power density of an audio signal, the method comprising:

providing a first estimate of the spectral noise power density of the audio signal $\tilde{S}_{bb}$;

determining a time dependent correction term that is a product of a correction factor K and a spectral power density estimation error $E_p$, wherein $$K=(\sigma_{E_{nrel}}^2\times\tilde{S}_{bb}^2)/(S_{yy}-\tilde{S}_{bb}),$$

where $\sigma_{E_{nrel}}^2$ corresponds to a variance of a relative spectral noise power density estimation error, and where $S_{yy}$ corresponds to a spectral signal power density of the audio signal;

combining the first estimate $\tilde{S}_{bb}$ and the correction term to obtain a second estimate of the spectral noise power density of the audio signal $\hat{S}_{bb}$:

$$\hat{S}_{bb}=\tilde{S}_{bb}+KE_p,$$

wherein the correction term is determined so that the spectral noise power density estimation error $E_n$ is reduced.

* * * * *